US006261110B1

(12) United States Patent
Hatazawa

(10) Patent No.: US 6,261,110 B1
(45) Date of Patent: Jul. 17, 2001

(54) CONVERTER FOR RECEIVING SATELLITE BROADCASTING HAVING EXTENSIBLE/RETRACTABLE WATERPROOF COVER ATTACHED AT ITS JUNCTION PORTION

(75) Inventor: Kenji Hatazawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/190,603

(22) Filed: Nov. 12, 1998

(30) Foreign Application Priority Data

Nov. 21, 1997 (JP) ..... 9-320830

(51) Int. Cl.[7] ..... H01R 13/52

(52) U.S. Cl. ..... 439/141; 439/521; 174/35 GC; 174/35 R; 174/138 F

(58) Field of Search ..... 174/135, 138 F, 174/158 R, 169, 35 C, 35 GC, 35 R, 136; 439/133, 135, 141, 521, 585

(56) References Cited

U.S. PATENT DOCUMENTS

| | | | | |
|---|---|---|---|---|
| 2,506,979 | * | 5/1950 | Varnum | 439/141 |
| 2,755,449 | * | 7/1956 | Anderson | 439/141 |
| 2,958,845 | * | 11/1960 | Dupre et al. | 439/585 |
| 3,449,706 | * | 6/1969 | Carissimi | 439/141 |
| 3,750,084 | * | 7/1973 | Gardner | 339/61 R |
| 4,173,385 | * | 11/1979 | Fenn et al. | 339/177 R |
| 4,400,050 | * | 8/1983 | Hayward | 439/585 |
| 4,540,230 | * | 9/1985 | Iversen et al. | 339/89 M |
| 4,545,633 | * | 10/1985 | McGeary | 439/141 |
| 4,734,541 | * | 3/1988 | Moran, Jr. | 174/35 R |
| 4,786,757 | * | 11/1988 | Owensby et al. | 174/35 C |
| 4,810,199 | * | 3/1989 | Kar | 439/141 |
| 4,869,679 | * | 9/1989 | Szegda | 439/272 |
| 4,913,673 | * | 4/1990 | Kobler | 439/548 |
| 5,208,499 | * | 5/1993 | Barber et al. | 310/51 |
| 5,448,254 | | 9/1995 | Schneeman et al. | 343/781 R |
| 5,631,443 | * | 5/1997 | Scrimpshire et al. | 174/35 R |
| 5,667,405 | | 9/1997 | Holliday | 439/585 |
| 5,877,452 | * | 3/1999 | McConnell | 439/585 |
| 5,975,949 | * | 11/1999 | Holliday et al. | 439/585 |
| 5,984,723 | * | 11/1999 | Wild | 439/585 |
| 5,991,597 | * | 11/1999 | Nagatomi et al. | 455/12.1 |

FOREIGN PATENT DOCUMENTS

| | | |
|---|---|---|
| 1-221087 | 9/1989 | (JP) . |
| 4-368001 | 12/1992 | (JP) . |
| 5-109449 | 4/1993 | (JP) . |
| 9-007703 | 1/1997 | (JP) . |

* cited by examiner

*Primary Examiner*—Dean A. Reichard
*Assistant Examiner*—Adolfo Nino
(74) *Attorney, Agent, or Firm*—Nixon & Vanderhye P.C.

(57) ABSTRACT

A converter for receiving satellite broadcasting includes a converter main body, a junction portion, provided to converter main body, to connect an interconnection member, and an extensible/retractable waterproof cover attached to junction portion. As waterproof cover is retracted, interconnection member is connected to junction portion. After the attaching operation, waterproof cover is expanded for preventing water penetration.

9 Claims, 8 Drawing Sheets

CONVERTER FOR RECEIVING SATELLITE BROADCASTING HAVING EXTENSIBLE/RETRACTABLE WATERPROOF COVER ATTACHED AT ITS JUNCTION PORTION

BACKGROUND OF THE INVENTION

1. Field of the Invention

The present invention relates generally to a converter for receiving satellite broadcasting, and more particularly, to a converter for receiving satellite broadcasting having a junction impervious to water.

2. Description of the Background Art

A converter for receiving satellite broadcasting attached to a parabolic antenna and provided outdoors has a junction portion for connecting a cable, and water penetrating through the junction could adversely affect the state of receiving broadcasting. Hence, a waterproof cap is fit on the junction having a connector connected thereto, or a tape is wound therearound to prevent water penetration. The manner to wind the tape is complicated, the operation efficiency is low, and if the adhesiveness of the tape deteriorates, the effect of preventing water could be spoiled. Thus, Japanese Patent Laying-Open No. 5-109449 discloses a converter having a water drip wall provided around the outer periphery of the fitting part of a waterproof cap, which provides improved attachability and waterproofness.

FIG. 1 is an exploded perspective view of a conventional converter 51 for receiving satellite broadcasting. Converter 51 is secured to an attaching arm 56 connected to a parabolic antenna which is not shown. At the bottom of converter 51, a junction portion 52 connecting a high frequency circuit inside and a coaxial cable for external output are provided. Junction portion 52 includes a screw portion 54 provided at a base 53 for engaging a connector and a water drip wall 55 provided concentrically around base 53. A coaxial cable 58 having a connector 57 coupled at its tip end is inserted through a waterproof cap 59 formed by soft, composite resin, and connector 57 is engaged to screw portion 54. Then, junction portion 52 and connector 57 are covered with waterproof cap 59 by fitting the opening of waterproof cap 59 through base 53, such that rainwater may be prevented from penetrating.

In general, as is often the case, an engineer selects such a waterproof cap depending upon the shape of a connector at the tip end of a cable, the kind of the cable or the manner to attach an antenna when the cable is attached. In order to secure a high waterproofing effect, a suitable waterproof cap should be selected. In other words, if a suitable waterproof cap is not selected, water could come into the junction.

The converter for receiving satellite broadcasting described above has a waterproof cap inserted and secured to the cable. As a result, the waterproof cap could come off when the cable is pulled or moved after it is attached, which may allow water to come into the junction portion.

SUMMARY OF THE INVENTION

It is an object of the present invention to provide a converter for receiving satellite broadcasting without impairing the working efficiency when a cable is attached and without impairing the waterproofness if the cable is moved.

According to one aspect of the present invention, a converter for receiving satellite broadcasting includes a converter main body, a junction portion provided at the converter main body for connecting an interconnection member, and an extensible/retractable waterproof cover attached to the junction portion.

Since the operator can attach a cable to a converter for receiving satellite broadcasting as the waterproof cover is retracted, the working efficiency is not lowered. Furthermore, since a waterproof cap is attached to the junction portion in an extended state, the movement of the cable does not adversely affect the waterproofness.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
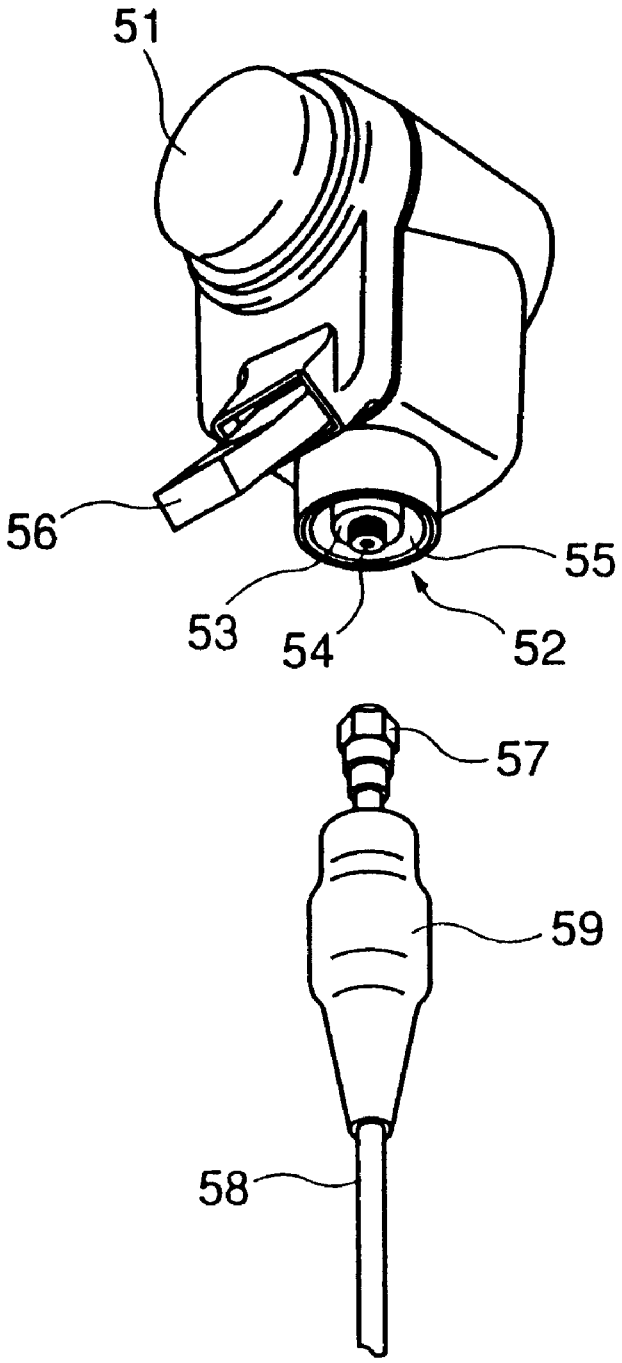
FIG. 1 PRIOR ART
FIG. 1 is an exploded perspective view showing a conventional converter for receiving satellite broadcasting.
Figures 2A, 2B:
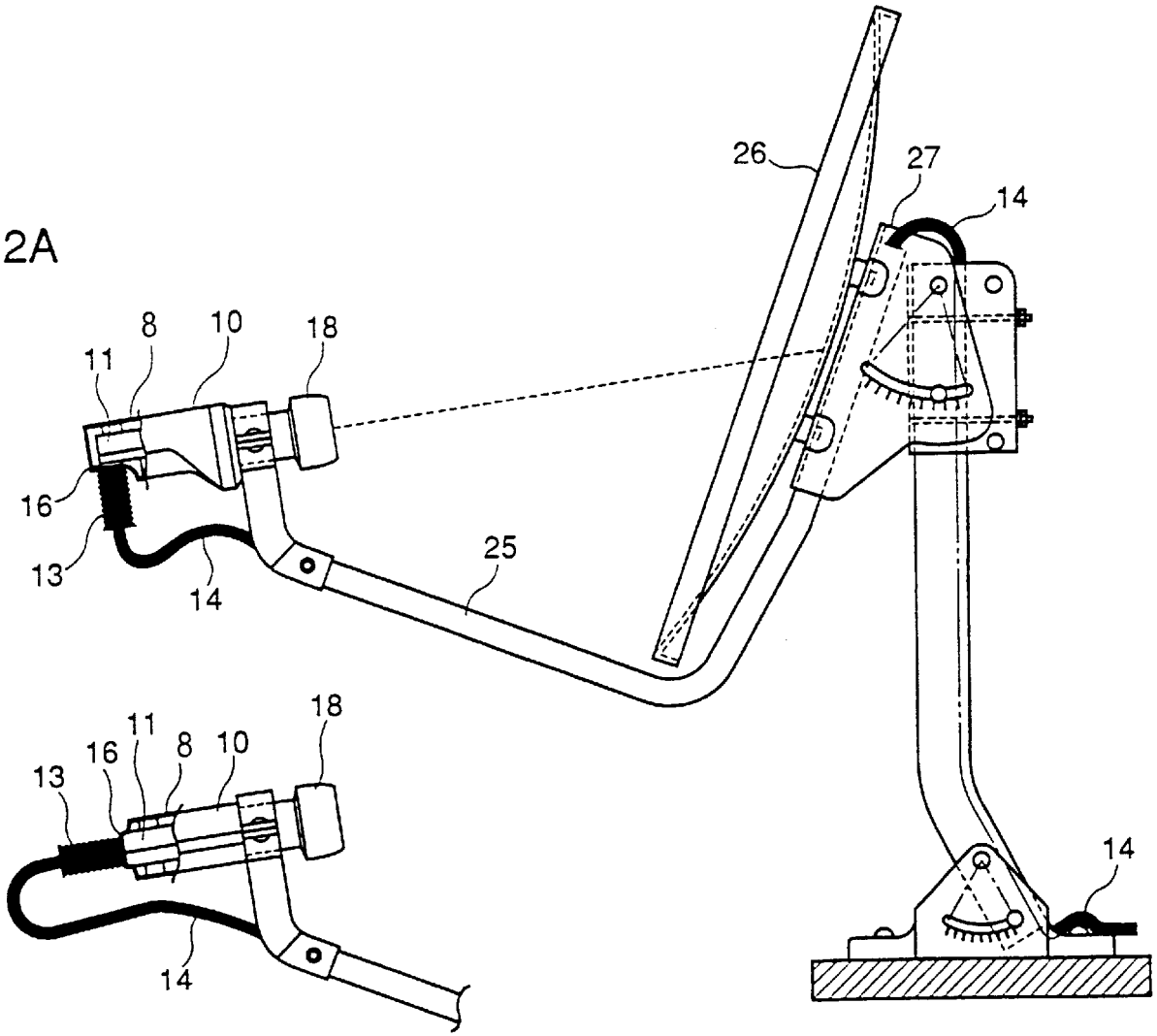
FIG. 2A is a side view of a satellite broadcasting antenna having a converter for receiving satellite broadcasting according to the present invention.
FIG. 2B is a side view of another example of a conventional converter for receiving satellite broadcasting.

Referring to FIG. 2A, an antenna for receiving satellite broadcasting includes a converter 10 for receiving satellite broadcasting, an arm 25 to secure a cabinet 8 for converter 10, a parabolic antenna 26, and a support base 27 to secure arm 25 and parabolic antenna 26.

Converter main body 11 is stored in cabinet 17 for converter 10 for receiving satellite broadcasting, and a primary horn 18 is attached to cabinet 8. Converter main body 11 is connected to a coaxial cable 14, an interconnection member at a junction portion 16. A waterproof cover 13 provided at junction portion 16 prevents water from coming into converter main body 11 through junction potion 16. Herein, the junction portion refers to a portion related to connecting the output connector of converter main body 11 and the output connector.

Waterproof cover 13 is extensible/retractable and folded before coaxial cable 14 is attached. After coaxial cable 14 is attached to converter 10 for receiving satellite broadcasting, waterproof cover 13 is extended to a prescribed length and covers the connection of the connector and coaxial cable 14 to prevent water from coming into junction portion 16. Waterproof cover 13 is directed perpendicularly to the ground and prevents water from penetrating through junction portion 16. Thus extensible/retractable waterproof cover 13 may be attached to various kinds of converters for receiving satellite broadcasting, and the same waterproof cover may be used for different kinds of cables and in different manners to attach an antenna.

Waterproof cover 13 may be formed by a soft, composite resin or rudder. These materials may contain a conductive material such as metal powder or a ferrite-based material to reduce electric wave leakage or unwanted radiation in the junction portion.

Electric waves from a satellite are collected to primary horn 18 attached to converter 10 for receiving satellite broadcasting by parabolic antenna 26. Signals in the 12 GHz band is frequency-converted into signals in the 1 GHz band by converter 10 for receiving satellite broadcasting, and the resultant signals are sent to a BS tuner unit (not shown) by coaxial cable 14 connected through junction portion 16.

Referring to FIG. 2B, coaxial cable 14 is connected through junction portion 16 at the backside of converter 10 for receiving satellite broadcasting. Extensible/retractable waterproof cover 13 is provided at junction portion 16, and waterproof cover 13 is attached in the direction close to the horizontal direction. Waterproof cover 13 covering junction portion 16 may prevent water penetration if junction portion 16 is directed close to the horizontal direction.

Referring to FIGS. 2A and 2B, since waterproof cover 13 is secured to converter 10 for receiving satellite broadcasting, waterproof cover 13 does not come off or slip off if the coaxial cable is for example pulled or moved by wind.

FIGS. 3A to 3D are schematic cross sectional views of a junction for a converter for receiving satellite broadcasting according to a first embodiment of the invention. FIG. 4 is a view showing the external configuration of the junction for the converter for receiving satellite broadcasting according to the first embodiment.

Figure 3A:
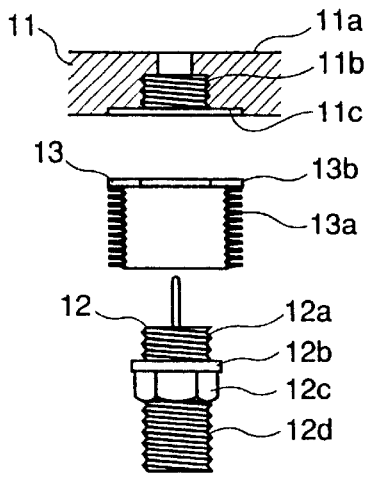
FIGS. 3A to 3D are schematic cross sectional views of the junction portion of a converter for receiving satellite broadcasting according to a first embodiment of the present invention.
Figure 4:
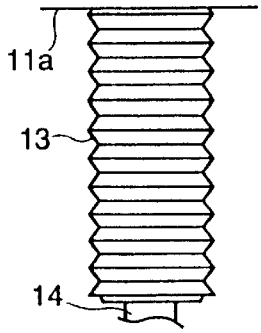
FIG. 4 is a view showing the external configuration of the junction portion of the converter for receiving satellite broadcasting according to the first embodiment.

In FIG. 3A, a female screw 11*b* to secure an output connector 12 and a recess 11*c* for fitting a waterproof cover 13 are formed in a chassis 11*a*, the outer frame of converter main body 11. A male screw 12*a* to engage female screw 11*b* in converter main body 11 is formed in output connector 12. Output connector 12 is provided with a circular brim portion 12*b* for securing waterproof cover 13 to chassis 11*a* and a hexagonal brim portion 12*c* for engaging male screw 12*a* to female screw 11*b*. Output connector 12 is further provided with a male screw 12*d* for connecting a coaxial cable.

Figure 3B:
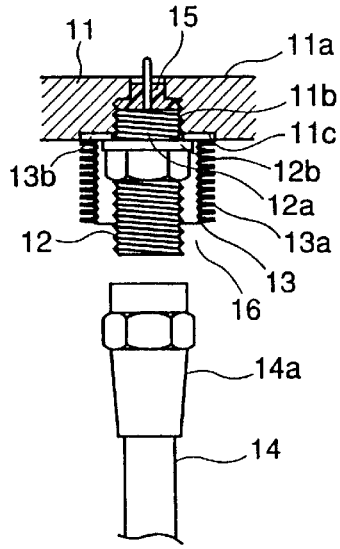

As shown in FIG. 3B, male screw 12*a* and female screw 11*b* are engaged to secure output connector 12 to chassis 11*a*, whereby junction portion 16 is formed. A sealing material such as silicon resin is injected into the tip end of output connector 12 in order to keep converter main body 11 airtight inside. In this state, the brim portion 13*b* of waterproof cover 13 is fit into recess 11*c*. Brim portion 13*b* is pressed and held by the brim portion 12*b* of output connector 12 such that waterproof cover 13 is secured to chassis 11*a*. A connection portion 14*a* is formed at the tip end of coaxial cable 14, in which a female screw is formed. FIG. 3B shows the state to be delivered to the market.

Figure 3C:
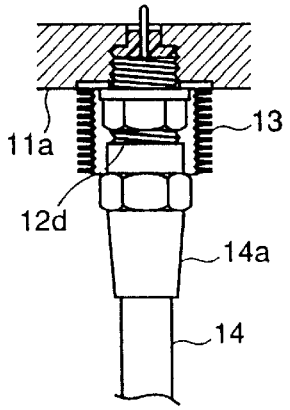
Figure 3D:
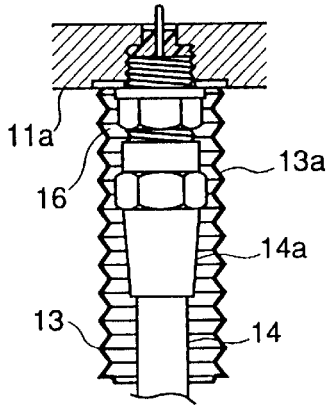

Furthermore, as shown in FIG. 3C, connection portion 14*a* is engaged to male screw 12*d*. As shown in FIG. 3D, the bellows 13*a* of waterproof cover 13 is expanded to cover connection portion 14*a*, and junction portion 16 is thus fully covered. Since the attaching operation completes simply by connecting coaxial cable 14 to junction portion 16 and expanding waterproof cover 13, the work load involved in attaching an antenna for receiving satellite broadcasting is alleviated. In addition, waterproof cover 13 attached to junction portion 16 is hardly affected by the movement of coaxial cable 14, and therefore waterproof cap 13 does not come off or slip off.

As shown in FIG. 4, waterproof cover 13 is attached to chassis 11*a* to cover output connector 12 and connection portion 14*a*. Since waterproof cover 13 is folded until coaxial cable 14 is connected and the connecting operation of the connector or the cable is not hindered, the working efficiency improves. Waterproof cover 13 having bellows 13*a* is easily bent along a coaxial cable and can cope with any sharp curve of the coaxial cable.

Converters for receiving satellite broadcasting according to second to eighth embodiments of the invention will be now described, in which the portions in the same construction and having the same function as the above will be denoted with the same reference characters and the description is not repeated.

Figure 5A:
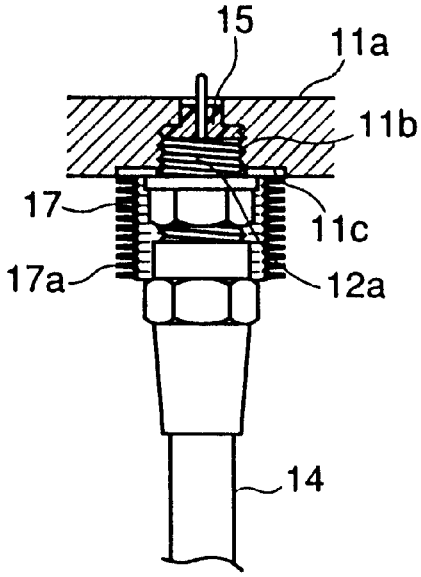
FIGS. 5A and 5B are schematic cross sectional views of a waterproof cover for a converter for receiving satellite broadcasting according to a second embodiment of the invention.
Figure 5B:
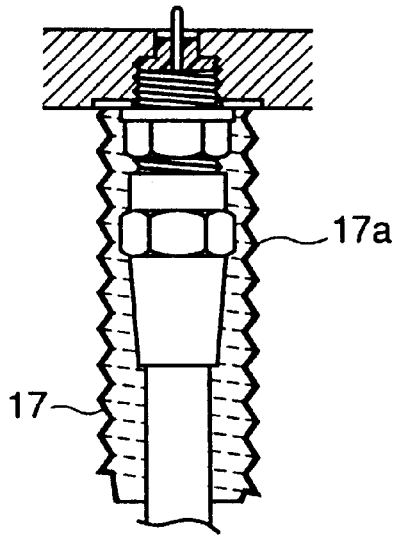
Figure 5C:
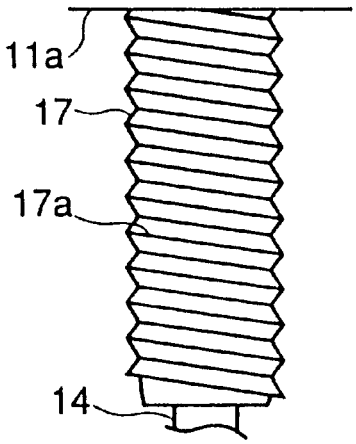
FIG. 5C is a view showing the external configuration of the waterproof cover for the converter for receiving satellite broadcasting according to the second embodiment.

FIGS. 5A to 5C are views of a waterproof cover for a converter for receiving satellite broadcasting according to the second embodiment of the invention. FIGS. 5A and 5B are schematic cross sectional views thereof, and FIG. 5C shows the external configuration thereof. The groove of a waterproof cover 17 is in a spiral form, and water coming into waterproof cover 17 for some reason could be advantageously let out along the spiral groove.

Figure 6A:
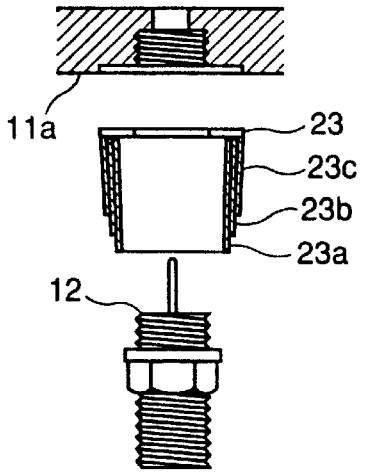
FIGS. 6A to 6D are schematic cross sectional views of a waterproof cover for a converter for receiving satellite broadcasting according to a third embodiment of the invention.
Figure 6B:
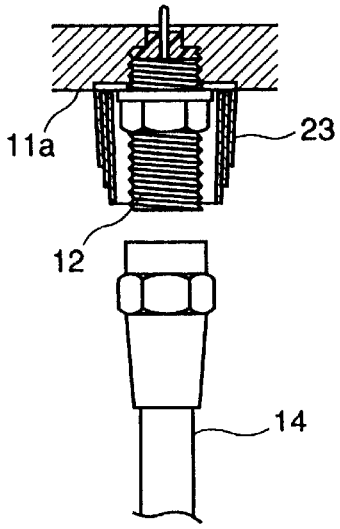
Figure 6C:
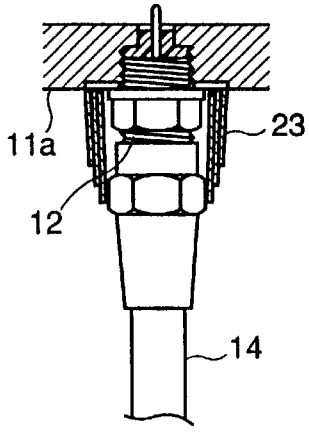
Figure 6D:
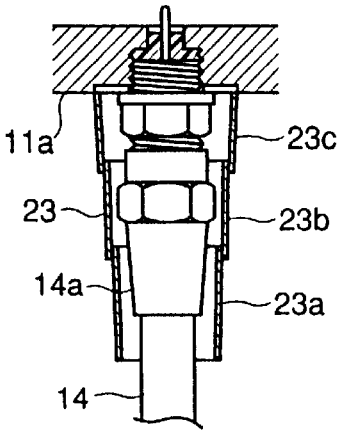
Figure 6E:
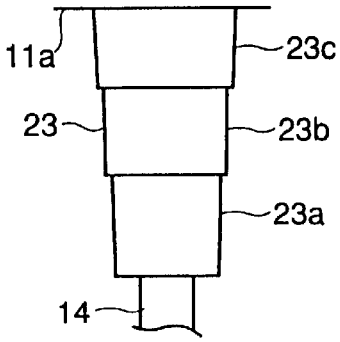
FIG. 6E is a view showing the external configuration of the waterproof cover for the converter for receiving satellite broadcasting according to the third embodiment.

FIGS. 6A to 6E are views of a waterproof cover for a converter for receiving satellite broadcasting according to a third embodiment of the invention. FIGS. 6A to 6D are schematic cross sectional views thereof, and FIG. 6E is a view showing the external configuration thereof. In FIG. 6A, a waterproof cover 23 is formed by combining truncated conical tubes 23*a*, 23*b* and 23*c*. As shown in FIG. 6B, waterproof cover 23 is inserted and secured between chassis 11*a* and output connector 12, and as shown in FIG. 6C, coaxial cable 14 is attached to output connector 12. Subsequently, as shown in FIGS. 6D and 6E, tubes 23*a*, 23*b* and 23*c* may be expanded to cover output connector 12 and connection portion 14*a*.

Figure 7A:
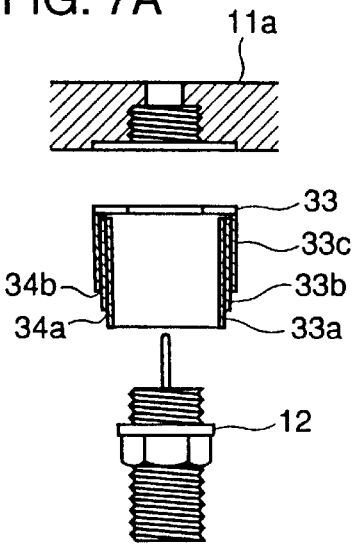
FIGS. 7A to 7D are schematic cross sectional views of a waterproof cover for a converter for receiving satellite broadcasting according to a fourth embodiment of the invention.
Figure 7B:
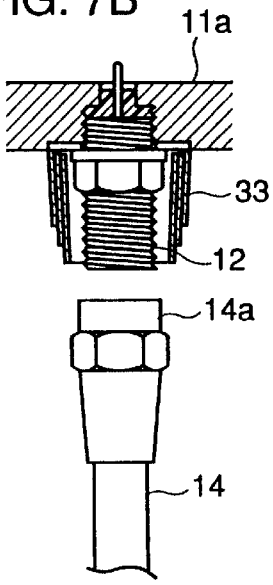
Figure 7C:
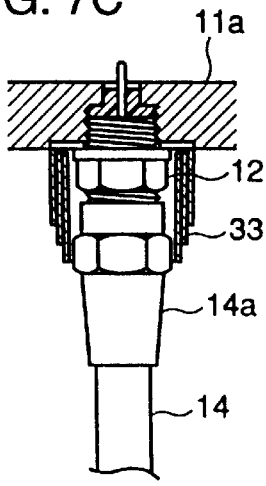
Figure 7D:
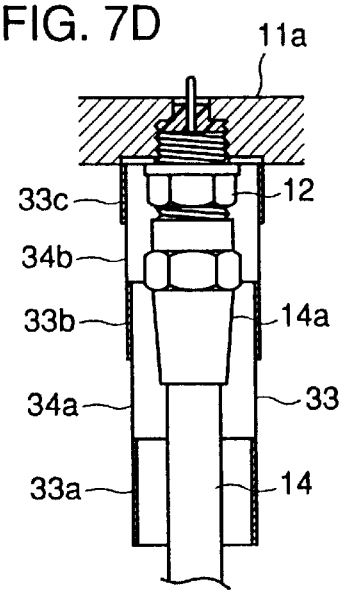
Figure 7E:
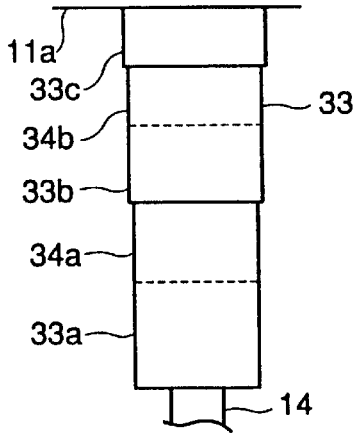
FIG. 7E is a view showing the external configuration of the waterproof cover for the converter for receiving satellite broadcasting according to the fourth embodiment.

FIGS. 7A to 7E are views of a waterproof cover for a converter for receiving satellite broadcasting according to the fourth embodiment of the invention. FIGS. 7A to 7D are schematic cross sectional views thereof and FIG. 7E is a view showing the external configuration thereof. In FIG. 7A, a waterproof cover 33 is formed by connecting thick cylindrical tubes 33*a*, 33*b* and 33*c* by thin portions 34*a* and 34*b* folded between the tubes. As shown in FIG. 7B, waterproof cover 33 is placed and secured between chassis 11*a* and output connector 12, and as shown in FIG. 7C, coaxial cable 14 is attached to output connector 12. As shown in FIGS. 7D and 7E, waterproof cover 33 is pulled downward to pull out thin portions 34*a* and 34*b* held between the tubes, so that waterproof cover may be expanded to cover output connector 12 and connection portion 14*a*.

Figure 8A:
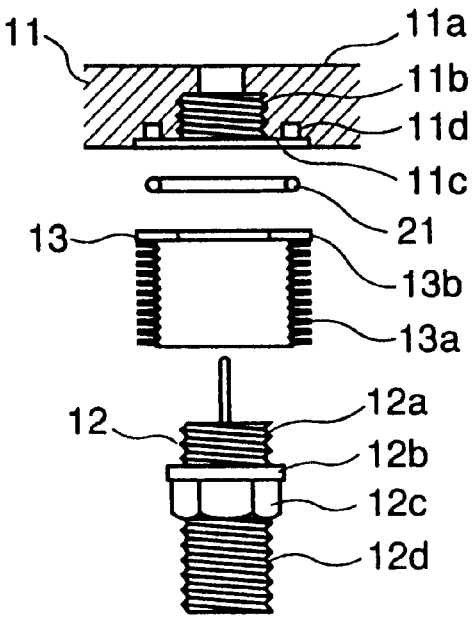
FIGS. 8A and 8B are schematic cross sectional views of the junction portion of a converter for receiving satellite broadcasting according to a fifth embodiment of the invention.
Figure 8B:
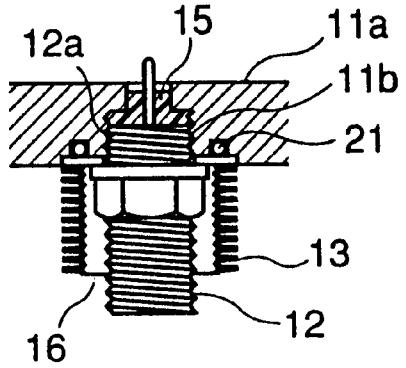

FIGS. 8A and 8B are schematic cross sectional views of a junction portion for a converter for receiving satellite broadcasting according to the fifth embodiment of the invention. In FIG. 8A, a recess 11*c* formed in chassis 11 is provided with a groove 11*d* for fitting an O-ring 21. As shown in FIG. 8B, O-ring 21 is fit into groove 11*d* and waterproof cover 13 is fit into the recess, and then output connector 12 is engaged to chassis 11*a* whereby junction portion 16 is formed. Furthermore, after coaxial cable 14 is attached, the bellows 13*a* of waterproof cover 13 is expanded. O-ring 21 functions to completely prevent water from coming into the gap between chassis 11*a* and waterproof cover 13, so that water penetration may be more surely prevented. It is clearly understood that a packing may be used instead of the O-ring 21 to achieve the same effect.

Figure 9A:
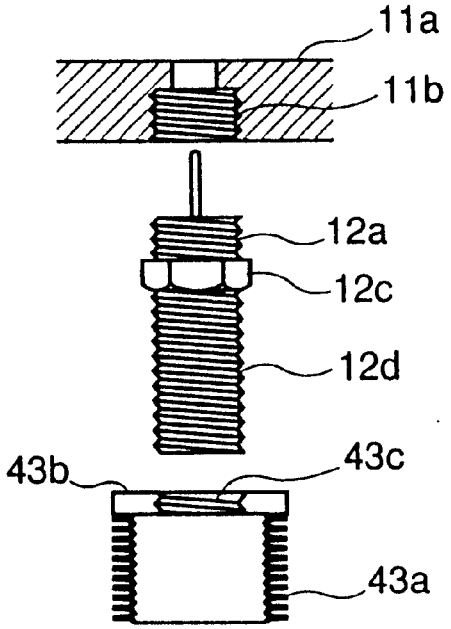
FIGS. 9A and 9B are schematic cross sectional views of the junction portion of a converter for receiving satellite broadcasting according to a sixth embodiment.
Figure 9B:
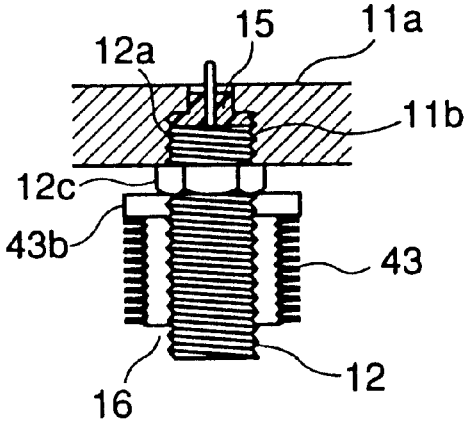

FIGS. 9A and 9B are schematic cross sectional views of a junction portion for a converter for receiving satellite broadcasting according to the sixth embodiment of the invention. In FIG. 9A, the brim portion 43*b* of a waterproof cover 43 is provided with a female screw 43*c* to engage the male screw 12*d* of an output connector 12. As shown in FIG. 9B, output connector 12 is engaged to a chassis 11*a* to form a junction portion 16. Subsequently, a female screw 12*c* is engaged to male screw 12*d* to attach waterproof cover 43. The shape of the screw portion of output connector 12 is standardized and therefore may be attached to any types of converters. If waterproof cover 43 is damaged, output connector 12 does not have to be removed for replacement, and only waterproof cover 43 may be removed for replacement. In addition, since waterproof cover 43 is attached to junction 16, it is less susceptible to the movement of coaxial cable 14, and waterproof cover 43 does not come off or slip off.

Figure 10A:
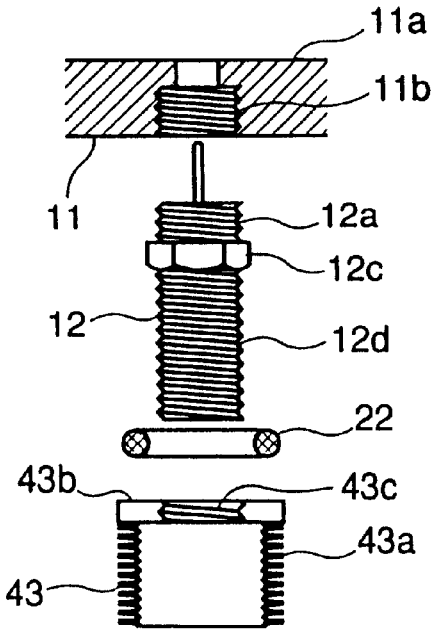
FIGS. 10A and 10B are schematic cross sectional views of the junction portion of a converter for receiving satellite broadcasting according to a seventh embodiment of the invention.
Figure 10B:
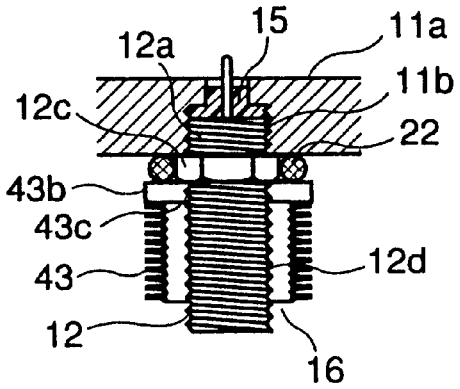

FIGS. 10A and 10B are schematic cross sectional views of a junction for a converter for receiving satellite broadcasting according to the seventh embodiment of the invention. In FIG. 10A, an O-ring 22 is provided between a chassis 11*a* and a waterproof cover 43, and O-ring 22 has a thickness slightly larger than that of a hexagonal brim portion 12*c*. After a male screw 12*a* and female screw 11*b* are engaged to attach output connector 12 to chassis 11*a* to constitute a junction portion 16, O-ring 22 is inserted through output connector 12 and waterproof cover 43 is attached to output connector 12.

As shown in FIG. 10B, a female screw 43*c* is engaged to a male screw 12*d*, and O-ring 22 is pressed against chassis 11*a* by a brim portion 43*b*. O-ring 22 is thus pressed to elastically deform to seal the gap between waterproof cover 43 and chassis 11*a*. Therefore, water may be surely prevented from coming in between waterproof cover 43 and chassis 11*a*.

Figure 11A:
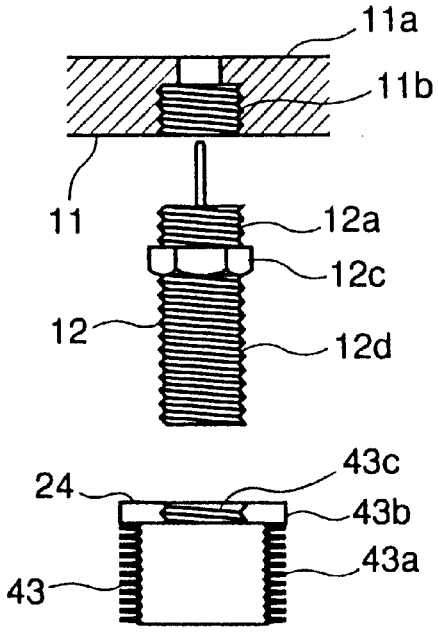
FIGS. 11A and 11B are schematic cross sectional views of the junction portion of a converter for receiving satellite broadcasting according to an eighth embodiment of the invention.
Figure 11B:
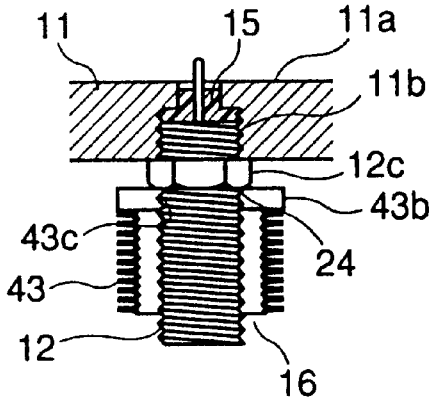

FIGS. 11A and 11B are schematic cross sectional views of a junction for a converter for receiving satellite broadcasting according to the eighth embodiment of the invention. As shown in FIG. 11A, resin 24 such as silicon resin having a sealing characteristic is applied on the female screw 43C of a waterproof cover 43. Then, an output connector 12 is attached to a chassis 11*a*, and a male screw 12*d* is engaged with the female screw 43*c* of waterproof cover 43, such that waterproof cover 43 is attached as shown in FIG. 11B. Thus applying resin 24 prevents water from coming in between a hexagonal brim portion 12*c* and a brim portion 43*b*, so that water penetration through the gap between waterproof cover 43 and output connector 12 may be more completely prevented.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A converter for receiving satellite broadcasting, comprising:

a converter main body;

a junction portion provided to said converter main body for connecting an interconnection member; and an extensible/retractable waterproof cover attached to said junction portion; wherein said waterproof cover is formed by coupling a plurality of truncated conical tubes and formed by a soft material including a conductive material and has a solid body portion to reduce electric wave leakage and unwanted radiation through the waterproof cover.

2. The converter for receiving satellite broadcasting as recited in claim 1, wherein said waterproof cover is formed by a soft material including a ferrite-based material.

3. The converter for receiving satellite broadcasting as recited in claim 1, wherein said waterproof cover is placed between said converter main body and an output connector to which said interconnection member is connected.

4. The converter for receiving satellite broadcasting as recited in claim 3, further comprising an O-ring provided between said converter main body and said waterproof cover.

5. The converter for receiving satellite broadcasting, comprising:

a converter main body;

a junction portion provided to said converter main body for connecting an interconnection member; and an extensible/retractable waterproof cover attached to said junction portion, wherein said waterproof cover includes thick cylindrical tubes; and a thin portion attached and folded between said thick tubes.

6. The converter for receiving satellite broadcasting as recited in claim 5, wherein said waterproof cover is formed by a soft material including a conductive material.

7. The converter for receiving satellite broadcasting as recited in claim 5, wherein said waterproof cover is formed by a soft material including a ferrite-based material.

8. The converter for receiving satellite broadcasting as recited in claim 5, wherein said waterproof cover is placed between said converter main body and an output connector to which said interconnection member is connected.

9. The converter for receiving satellite broadcasting as recited in claim 8, further comprising an O-ring provided between said converter main body and said waterproof cover.

* * * * *